US005755984A

United States Patent [19]

Yamamoto

[11] Patent Number: 5,755,984

[45] Date of Patent: May 26, 1998

[54] AGENTS FOR AND METHODS OF LUBRICATING SYNTHETIC YARNS FOR HEAT TREATMANT PROCESS

[75] Inventor: Hisao Yamamoto, Aichi, Japan

[73] Assignee: Takemoto Yushi Kabushiki Kaisha, Aichi, Japan

[21] Appl. No.: 911,286

[22] Filed: Aug. 14, 1997

[51] Int. Cl.[6] ..... D06M 13/513; D06M 13/517

[52] U.S. Cl. ..... 252/8.84

[58] Field of Search ..... 252/8.84

[56] References Cited

U.S. PATENT DOCUMENTS 3,423,314 1/1969 Campbell ..... 252/8.84
3,772,069 11/1973 Daniel ..... 252/8.84
4,554,671 11/1985 Ogiso et al. ..... 252/8.84
4,561,987 12/1985 Yamamoto et al. ..... 252/8.84
5,061,384 10/1991 Suzuki et al. ..... 252/8.84

*Primary Examiner*—David Brunsman
*Attorney, Agent, or Firm*—Keiichi Nishimura

[57] ABSTRACT

A lubricating agent obtained by mixing a polyether compound and cyclic polyorganosiloxane of a specified type at a specified ratio is applied at a specified ratio to synthetic yarns which are to be subjected to a heat treatment process such that heater deposits can be eliminated.

10 Claims, No Drawings

AGENTS FOR AND METHODS OF LUBRICATING SYNTHETIC YARNS FOR HEAT TREATMANT PROCESS

BACKGROUND OF THE INVENTION

This invention relates to lubricating agents for synthetic yarns which are subjected to a heat treatment process (hereinafter referred to simply as "the lubricating agents") and methods of providing lubricity to synthetic yarns to be subjected to a heat treatment process (hereinafter referred to simply as "the lubricating methods"). When synthetic yarns are subjected to a heat treatment process such as a false twisting process, it is important to eliminate heater deposits in such a process for obtaining high-quality false twisted yarns by preventing the generation of fuzz and occurrence of yarn breakage. The present invention relates to lubricating agents and lubricating methods capable of effectively eliminating problems of heater deposits.

It has been known to use a mixture of polyether and polyorganosiloxane compounds as a lubricating agent for eliminating heater deposits. Examples of polyorganosiloxane compound to be mixed with a polyether compound to make a prior art lubricating agent include (1) polydimethylsiloxane and fluoroalkyl modified polydimethyl polysiloxane with viscosity at 25° C. greater than $30\times10^{-6}m^2/s$ and surface tension at 25° C. less than 28 dyne/cm (Japanese Patent Publication Tokkai 54-46923), (2) polydimethylsiloxane with viscosity at 30° C. greater than $15\times10^{-6}m^2/s$ (Japanese Patent Publication Tokkai 48-53093), (3) phenyl polysiloxane with viscosity at 30° C. in the range of $10\times10^{-6}$ $-80\times10^{-6}m^2/s$ (Japanese Patent Publication Tokko 47-50657 and U.S. Pat. No. 3,756,972), and (4) polyether modified silicone (Japanese Patent Publication Tokko 63-57548 and U.S. Pat. No. 4,561,987). These prior art lubricating agents are not capable of sufficiently eliminating heater deposits in heat treatment processes, however, and they hardly have the effect of eliminating heater deposits in the case of false twisting processes using a recently developed ultra high temperature short heater of temperature exceeding 300° C. If heater deposits cannot be eliminated in a heat treatment process, high quality textured yarns cannot be produced because of the generation of fuzz and occurrence of yarn breakage.

SUMMARY OF THE INVENTION

The problem to be overcome by this invention is that prior art lubricating agents cannot eliminate heater deposits sufficiently in heat treatment processes and, in particular, in false twisting processes using an ultra high temperature short heater.

In view of the above, the inventor herein diligently looked for lubricating agents and lubricating methods capable of effectively eliminating heater deposits in heat treatment processes of synthetic yarns and in particular in false twisting processes using an ultra high temperature short heater. As a result, it was discovered that use should be made of lubricating agents comprising a polyether compound and cyclic polyorganosiloxane of a specified type and containing them at a specified ratio and that such an agent should be applied at a specified ratio to synthetic yarns which are to be subjected to a heat treatment process.

DETAILED DESCRIPTION OF THE INVENTION

This invention relates to lubricating agents comprising a polyether compound and cyclic polyorganosiloxane of one or more kinds selected from Type A and Type B defined below, containing them at a weight ratio (polyether compound/cyclic polyorganosiloxane) of 100/0.05–100/12 and lubricating methods comprising the step of applying such a lubricating agent to synthetic yarns at a rate of 0.1–3 weight %. Type A being cyclic polyorganosiloxane having within its molecule 4–14 siloxane units shown below by Formula (1) connected in a ring, Type B being cyclic polyorganosiloxane having within its molecule a total of 4–14 siloxane units shown below by Formula (1) and siloxane units shown below by Formula (2) connected in a ring such that the siloxane units shown by Formula (2) are less than 25 molar % of all siloxane units, Formula (1) being:

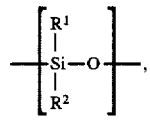

and Formula (2) being:

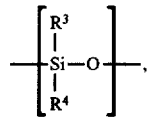

where $R^1$ and $R^2$ are same or different alkyl groups with 1–4 carbon atoms, $R^3$ is fluoroalkyl group with 1–4 carbon atoms, and $R^4$ is fluoroalkyl group with 1–4 carbon atoms or alkyl group with 1–4 carbon atoms.

Examples of siloxane unit shown by Formula (1) include (1) dialkylsiloxane units substituted by the same alkyl groups such as dimethylsiloxane units, diethylsiloxane units, dipropylsiloxane units and dibutylsiloxane units, and (2) dialkylsiloxane units substituted by different alkyl groups such as methylethylsiloxane units and methylbutylsiloxane units. Those of cyclic polyorganosiloxane of Type A having dimethylsiloxane units as siloxane unit shown by Formula (1) are preferable. Those, of which all of the siloxane units are dimethylsiloxane units, are even more preferable.

Examples of siloxane unit shown by Formula (2) include (1) difluoroalkylsiloxane units and (2) fluoroalkylalkylsiloxane units. Examples of fluoroalkyl group contained in such siloxane units include not only partially fluorinated alkyl groups such as γ-trifluoropropyl group and β, γ-pentafluoropropyl group but also fully fluorinated alkyl groups such as heptafluoropropyl group and pentafluoroethyl group. Those of cyclic polyorganosiloxane of Type B, of which the siloxane units shown by Formula (1) are dimethylsiloxane units and the siloxane units shown by Formula (2) are partially fluorinated alkyl groups, are preferred. Although the siloxane units shown by Formula (2) in cyclic polyorganosiloxane of Type B were simply said to be less than 25 molar % of all siloxane units, it is preferable that this ratio be in the range of 7–25 molar %.

As for the polyether compound to be mixed with cyclic polyorganosiloxane according to this invention, use may be made of known kinds such as disclosed in Japanese Patent Publications Tokkai 56-31077 and Tokko 63-57548. Examples of such polyether compound include polyether polyols having oxyethylene units and oxypropylene units as their oxyalkylene units such as polyether monools, polyether diols and polyether triols. According to this invention, it is preferred to use a polyether compound with average molecular weight of 700–20000. Polyether compounds according to this invention include mixtures of polyether compounds having different molecular weights. When such a mixture is used, mixtures of a polyether compound with average molecular weight of 1000–3000 and another with average molecular weight of 5000–15000 are preferred.

As stated above, lubricating agents according to this invention not only comprise a polyether compound and cyclic polyorganosiloxane but contain them at a weight ratio of 100/0.05–100/12, but a weight ratio in the range of 100/0.2–100/5 is preferable.

According to this invention, a lubricating agent as described above is applied to synthetic yarns, which are to be subjected to a heat treatment process, at a rate of 0.1–3 weight % with respect to the yarns, but more preferably at a rate of 0.2–1 weight %. The application of the lubricating agent is normally effected immediately after the yarns are spun in the spinning process and, after the synthetic yarns with the lubricating agent thus applied thereon are subjected to a winding process, the wound yarns are subjected to a heat treatment process. Synthetic yarns with a lubricating agent applied thereon may be in the form of undrawn yarns, partially oriented yarns or fully oriented yarns, depending on how they are wound. According to the present invention, however, it is preferable to carry out the winding process at the speed of winding in the range of 2500–7500 m/minute to form partially oriented yarns or fully oriented yarns.

As repeated above, lubricating methods according to this invention make it possible to provide improved lubricity to synthetic yarns by applying a lubricating agent of this invention thereon such that heater deposits can be eliminated in their heat treatment process. Examples of such heat treatment process include the drawing process, the twisting process, the crimping process and the false twisting process, but the lubricating agents and methods of this invention are particularly effective when the synthetic yarns are subjected to a false twisting process. Examples of false twister which may be used in such a false twisting process include (1) those with a contact heater system provided with a heater at temperature 150°–230° C. and of length 150–250 cm and adapted to have synthetic yarns running while in contact with its heater plate, and (2) those with a heater at temperature 300°–600° C. and of length 20–150 cm and adapted to have synthetic yarns running without contacting its heater plate. Lubricating agents and methods according to this invention are particularly effective, however, when use is made of a false twister equipped with an ultra high temperature short heater at temperature 350°–550° C. and length of 20–120 cm for false twisting.

The present invention does not impose any particular limitation on the oiling method for applying a lubricating agent on synthetic yarns. Examples of the oiling method include conventional methods such as the roller oiling method, the guide oiling method by the use of a measuring pump, the dip oiling method and the spray oiling method, but the roller oiling method and the guide oiling method with the use of a measuring pump are preferred oiling methods.

When a lubricating agent of this invention is applied to synthetic yarns, it may be applied in the form of an aqueous emulsion, as a solution with an organic solvent or by itself, but it is preferred to use it as an aqueous emulsion. This may be done by using an appropriate amount of an emulsifier, if necessary, but it is preferred to prepare the aqueous emulsion such that a lubricating agent is contained by 5–30 weight %. When a lubricating agent is applied to synthetic yarns, other agents such as an antistatic agent, an antioxidant, an antiseptic and an antirust agent may be included in the lubricating agent or the aqueous emulsion, depending on the purpose of its use but their contents should preferably be made as small as possible.

Examples of synthetic yarns, to which the lubricating agents and methods of this invention can be applied, include (1) polyester filaments having ethylene terephthalate as their main constituent units, (2) polyamide filaments such as 6 nylon and 6.6 nylon, (3) polyacryl filaments such as polyacrylnitrile and modacryl filaments, and (4) polyolefin filaments such as polyethylene and polypropylene filaments, but the lubricating agents and methods of this invention are particularly effective when applied to polyester and polyamide filaments and particularly more effective when applied to partially oriented polyester yarns, partially oriented polyamide yarns or direct spin-draw polyester yarns.

Manners of using lubricating agents and methods of this invention are described next by way of the following twenty examples of application:

Application No. 1 wherein the lubricating agent is a mixture of polyether compound (P-1) which is a 50/50 (by weight) mixture of butoxy polyalkyleneglycolether of average molecular weight 1500 and polyalkyleneglycolether of average molecular weight 7000 and cyclic polydimethylsiloxane (A-1) with 6 dimethylsiloxane units connected in a ring at a weight ratio of (P-1)/(A-1)=100/2 and wherein this lubricating agent is used by first making an aqueous emulsion thereof, next applying this aqueous emulsion to partially oriented polyester filaments at a rate of 0.4 weight % as lubricating agent and subjecting these filaments to a false twisting process using a false twister with a contact heater at temperature of 215° C.;

Application No. 2 wherein an aqueous emulsion is made of the lubricating agent of Application No. 1 and applied at a rate of 0.4 weight % as lubricating agent to partially oriented polyester yarns which are then subjected to a false twisting process using a false twister with a high temperature short heater at temperature 500° C.;

Application No. 3 wherein the lubricating agent is a mixture of polyether compound (P-1) and cyclic polydimethylsiloxane (A-1) at a weight ratio of (P-1)/(A-1)=100/5 and wherein this lubricating agent is used by first making an aqueous emulsion thereof, next applying this aqueous emulsion to partially oriented polyester filaments at a rate of 0.4 weight % as lubricating agent and subjecting these filaments to a false twisting process using a false twister with a contact heater at temperature of 215° C.;

Application No. 4 wherein an aqueous emulsion is made of the lubricating agent of Application No. 3 and applied at a rate of 0.4 weight % as lubricating agent to partially oriented polyester yarns which are then subjected to a false twisting process using a false twister with a high temperature short heater at temperature 500° C.;

Application No. 5 wherein the lubricating agent is a mixture of polyether compound (P-1) and cyclic polydimethylsiloxane (A-2) with 12 dimethylsiloxane units connected in a ring at a weight ratio of (P-1)/(A-2)=100/2 and wherein this lubricating agent is used by first making an aqueous emulsion thereof, next applying this aqueous emulsion to partially oriented polyester filaments at a rate of 0.4 weight % as lubricating agent and subjecting these filaments to a false twisting process using a false twister with a contact heater at temperature of 215° C.;

Application No. 6 wherein an aqueous emulsion is made of the lubricating agent of Application No. 5 and applied at a rate of 0.4 weight % as lubricating agent to partially oriented polyester yarns which are then subjected to a false twisting process using a false twister with a high temperature short heater at temperature 500° C.;

Application No. 7 wherein the lubricating agent is a mixture of polyether compound (P-1) and cyclic polydimethylsiloxane (A-2) at a weight ratio of (P-1)/(A-2)=100/5 and wherein this lubricating agent is used by first making an aqueous emulsion thereof, next applying this aqueous emulsion to partially oriented polyester filaments at a rate of 0.4 weight % as lubricating agent and subjecting these filaments to a false twisting process using a false twister with a contact heater at temperature of 215° C.;

Application No. 8 wherein an aqueous emulsion is made of the lubricating agent of Application No. 7 and applied at a rate of 0.4 weight % as lubricating agent to partially oriented polyester yarns which are then subjected to a false twisting process using a false twister with a high temperature short heater at temperature 500° C.;

Application No. 9 wherein the lubricating agent is a mixture of polyether compound (P-1) and cyclic polyorganosiloxane (B-1) with 5 dimethylsiloxane units and one methyl-γ-trifluoropropylsiloxane unit connected in a ring at a weight ratio of (P-1)/(B-1)=100/2 and wherein this lubricating agent is used by first making an aqueous emulsion thereof, next applying this aqueous emulsion to partially oriented polyester filaments at a rate of 0.4 weight % as lubricating agent and subjecting these filaments to a false twisting process using a false twister with a contact heater at temperature of 215° C.;

Application No. 10 wherein an aqueous emulsion is made of the lubricating agent of Application No. 9 and applied at a rate of 0.4 weight % as lubricating agent to partially oriented polyester yarns which are then subjected to a false twisting process using a false twister with a high temperature short heater at temperature 500° C.;

Application No. 11 wherein the lubricating agent is a mixture of polyether compound (P-1) and cyclic polyorganosiloxane (B-2) with 11 dimethylsiloxane units and one methyl-γ-trifluoropropylsiloxane unit connected in a ring at a weight ratio of (P-1)/(B-2)=100/5 and wherein this lubricating agent is used by first making an aqueous emulsion thereof, next applying this aqueous emulsion to partially oriented polyester filaments at a rate of 0.4 weight % as lubricating agent and subjecting these filaments to a false twisting process using a false twister with a contact heater at temperature of 215° C.;

Application No. 12 wherein an aqueous emulsion is made of the lubricating agent of Application No. 10 and applied at a rate of 0.4 weight % as lubricating agent to partially oriented polyester yarns which are then subjected to a false twisting process using a false twister with a high temperature short heater at temperature 500° C.;

Application No. 13 wherein the lubricating agent is a mixture of polyether compound (P-2) which is a 90/10 (by weight) mixture of butoxy polyalkyleneglycolether of average molecular weight 1500 and polyalkyleneglycolether of average molecular weight 10000 and cyclic polydimethylsiloxane (A-1) at a weight ratio of (P-2)/(A-1)=100/0.5 and wherein this lubricating agent is used by first making an aqueous emulsion thereof, next applying this aqueous emulsion to partially oriented nylon filaments at a rate of 0.45 weight % as lubricating agent and subjecting these filaments to a false twisting process using a false twister with a contact heater at temperature of 225° C.;

Application No. 14 wherein an aqueous emulsion is made of the lubricating agent of Application No. 13 and applied at a rate of 0.45 weight % as lubricating agent to partially oriented nylon yarns which are then subjected to a false twisting process using a false twister with a high temperature short heater at temperature 440° C.;

Application No. 15 wherein the lubricating agent is a mixture of polyether compound (P-2) and cyclic polyorganosiloxane (B-1) at a weight ratio of (P-2)/(B-1)=100/5 and wherein this lubricating agent is used by first making an aqueous emulsion thereof, next applying this aqueous emulsion to partially oriented nylon filaments at a rate of 0.45 weight % as lubricating agent and subjecting these filaments to a false twisting process using a false twister with a contact heater at temperature of 215° C.;

Application No. 16 wherein an aqueous emulsion is made of the lubricating agent of Application No. 15 and applied at a rate of 0.45 weight % as lubricating agent to partially oriented nylon yarns which are then subjected to a false twisting process using a false twister with a high temperature short heater at temperature 500° C.;

Application No. 17 wherein an aqueous emulsion is made of the lubricating agent of Application No. 1 and applied at a rate of 0.4 weight % as lubricating agent to direct spin-draw polyester yarns which are then subjected to a false twisting process using a false twister with a contact heater at temperature 215° C.;

Application No. 18 wherein an aqueous emulsion is made of the lubricating agent of Application No. 1 and applied at a rate of 0.4 weight % as lubricating agent to direct spin-draw polyester yarns which are then subjected to a false twisting process using a false twister with a high temperature short heater at temperature 500° C.;

Application No. 19 wherein an aqueous emulsion is made of the lubricating agent of Application No. 3 and applied at a rate of 0.4 weight % as lubricating agent to direct spin-draw polyester yarns which are then subjected to a false twisting process using a false twister with a contact heater at temperature 215° C.; and Application No. 20 wherein an aqueous emulsion is made of the lubricating agent of Application No. 3 and applied at a rate of 0.4 weight % as lubricating agent to direct spin-draw polyester yarns which are then subjected to a false twisting process using a false twister with a high temperature short heater at temperature 500° C.

EXAMPLES

The invention is explained next by way of test examples and comparison examples, but these test examples are not intended to limit the scope of the invention. In what follows, "part" will mean "weight part" and "%" will mean "weight %."

Part 1 (Preparation of Lubricating Agents)

Lubricating agent (Test Example 1) was prepared by mixing 50 parts of butoxy polyalkyleneglycolether (molar ratio of oxyethylene units to oxypropylene units=70/30, random addition, average molecular weight=1500), 50 parts of polyalkyleneglycolether (molar ratio of oxyethylene units to oxypropylene units=20/80, random addition, average molecular weight=7000) and 2 parts of cyclic polydimethylsiloxane with 6 dimethylsiloxane units connected in a ring. Other lubricating agents were prepared similarly as shown in Table 1.

TABLE 1

| | Polyether Compound | | Polyorganosiloxane | | | | | | |
|---|---|---|---|---|---|---|---|---|---|
| | | | | Siloxane Unit of Formula 1 | | Siloxane Unit of Formula 2 | | | |
| | Kind | Amt (%) | Kind | Kind | RN | Kind | RN | Amt (%) | Weight Ratio |
| Test Examples | | | | | | | | | |
| 1 | P-1 | 100 | A-1 | DM-1 | 6 | | | 2 | 100/2 |
| 2 | P-1 | 100 | A-1 | DM-1 | 6 | | | 5 | 100/5 |
| 3 | P-1 | 100 | A-2 | DM-1 | 12 | | | 2 | 100/2 |

TABLE 1-continued

| | Polyether Compound | | Polyorganosiloxane | | | | | | |
|---|---|---|---|---|---|---|---|---|---|
| | | | | Siloxane Unit of Formula 1 | | Siloxane Unit of Formula 2 | | | |
| | Kind | Amt (%) | Kind | Kind | RN | Kind | RN | Amt (%) | Weight Ratio |
| 4 | P-1 | 100 | A-2 | DM-1 | 12 | | | 5 | 100/5 |
| 5 | P-1 | 100 | B-1 | DM-1 | 5 | MF-1 | 1 | 2 | 100/2 |
| 6 | P-1 | 100 | B-2 | DM-1 | 11 | MF-1 | 1 | 5 | 100/5 |
| 7 | P-2 | 100 | A-1 | DM-1 | 6 | | | 0.5 | 100/0.5 |
| 8 | P-2 | 100 | B-1 | DM-1 | 5 | MF-1 | 1 | 5 | 100/5 |
| Comparison Examples | | | | | | | | | |
| 1 | P-1 | 100 | C-1 | DM-1 | 3 | | | 5 | 100/5 |
| 2 | P-1 | 100 | C-2 | DM-1 | 16 | | | 5 | 100/5 |
| 3 | P-1 | 100 | C-3 | DM-1 | 2 | MF-1 | 1 | 5 | 100/5 |
| 4 | P-1 | 100 | C-4 | DM-1 | 15 | MF-1 | 1 | 5 | 100/5 |
| 5 | P-1 | 100 | C-5 | | | | | 5 | 100/5 |
| 6 | P-1 | 100 | C-6 | | | | | 5 | 100/5 |
| 7 | P-1 | 100 | C-7 | | | | | 5 | 100/5 |
| 8 | P-1 | 100 | | | | | | | 100/0 |
| 9 | P-2 | 100 | C-1 | DM-1 | 3 | | | 5 | 100/5 |
| 10 | P-2 | 100 | C-2 | DM-1 | 16 | | | 5 | 100/5 |
| 11 | P-2 | 100 | C-3 | DM-1 | 2 | MF-1 | 1 | 5 | 100/5 |
| 12 | P-2 | 100 | C-4 | DM-1 | 15 | MF-1 | 1 | 5 | 100/5 |
| 13 | P-2 | 100 | C-5 | | | | | 5 | 100/5 |
| 14 | P-2 | 100 | C-6 | | | | | 5 | 100/5 |
| 15 | P-2 | 100 | C-7 | | | | | 5 | 100/5 |
| 16 | P-2 | 100 | A-1 | DM-1 | 6 | | | 15 | 100/15 |

In Table 1:
RN: Repetition number
Weight Ratio: Weight ratio between polyether compound and polyorganosiloxane
Amt: Amount which was used
P-1: Mixture of 50 parts of butoxy polyalkyleneglycolether of average molecular weight 1500 obtained by random addition of oxyethylene units and oxypropylene units at molar ratio of 70/30 and 50 parts of polyalkyleneglycolether of average molecular weight 7000 obtained by random addition of oxyethylene units and oxypropylene units at molar ratio of 20/80
P-2: Mixture of 90 parts of butoxy polyalkyleneglycolether of average molecular weight 1500 obtained by random addition of oxyethylene units and oxypropylene units at molar ratio of 60/40 and 10 parts of polyalkyleneglycolether of average molecular weight 10000 obtained by random addition of oxyethylene units and oxypropylene units at molar ratio of 25/75
DM-1: Dimethylsiloxane unit
MF-1: Methyl-γ-trifluoropropylsiloxane unit
C-5: Linear polydimethylsiloxane with average molecular weight 3000
C-6: Linear polyorganosiloxane with one methylphenylsiloxane unit and 13 dimethylsiloxane units bonded linearly
C-7: Polyether modified silicone with average molecular weight 8600 with 92 weight % of polyoxyalkyleneether block obtained by random addition of oxyethylene units and oxypropylene units at molar ratio of 15/15

Part 2 (Adhesion of Lubricating Agents onto Partially Oriented Polyester Yarns and Its Evaluation)

An aqueous emulsion with 15% concentration of lubricating agent was obtained by mixing 3 parts of dibutylethanolamine salt of polyoxyethylene (4) lauryl-ether phosphate as antistatic agent and 7 parts of polyoxyethylene (7) nonylphenylether as emulsifier to 100 parts of each lubricating agent obtained in Part 1 and adding water to this mixture. After a polyethylene terephthalate chip with intrinsic viscosity 0.64 containing titanium oxide by 0.6 weight % was dried by a conventional method, it was spun by means of an extruder. The aqueous emulsion was applied by a roller oiling method to the running filaments which were extruded from the spinneret and cooled for caking, and the filaments were wound up at the rate of 3400 m/minute without mechanical drawing to obtain a wound 10 kg cake of 75-denier, 96-filament partially oriented yarns, as shown in Table 2.

Each of the cakes, obtained as described above, was used to carry out false twisting by means of a false twister with a contact heater under the conditions described below to evaluate the heater deposit:

False twister with a contact heater: Model SDS1200B of Ernest Skrag and Sons.

Speed of yarn: 850 m/minute

Draw ratio: 1.518

Twisting system: One guide disk on entrance side, one guide disk on exit side, and seven hard polyurethane rubber disks Heater on twist side: 2.5 m in length with surface temperature of 215° C.

Heater on untwisting side: None

Intended number of twisting: 3400 t/m

Days of continuous operation: 20

The results of evaluations are also shown in Table 2.

After a continuous operation for 20 days under the conditions given above, heater tar on the yarn path on the surface of the heater was scraped off by means of a brush, collected and weighed. Weights were measured for ten spindles and the results are shown as average weight (in mg) per spindle.

Each of the cakes, obtained as described above, was used to carry out false twisting by means of a false twister with a high temperature short heater under the following conditions to evaluate the heater deposit:

False twister with a high temperature short heater: Model HTS-1500 of Teijin Seiki Co., Ltd.

Speed of yarn: 1100 m/minute

Draw ratio: 1.518

Twisting system: One guide disk on entrance side, one guide disk on exit side, and seven hard polyurethane rubber disks Heater on twist side: 1 m in length with entrance section of 25 cm and exit section of 75 cm and surface temperature 500° C. at the entrance section and 420° C. at the exit section Heater on untwisting side: None Intended number of twisting: 3400 t/m Days of continuous operation: 30

The results of evaluations are also shown in Table 2.

After a continuous operation for 30 days under the conditions given above, adhering sludge on the surface of the ceramic guide for the yarn path was scraped off by means of a brush, collected and weighed. Weights were measured and are shown as described above for the case of a false twister with a contact heater.

TABLE 2

| | Evaluation of Heater Deposit | | |
|---|---|---|---|
| Lubricating agent which was used | Adhesion Percentage (%) | Contact Heater (mg) | High Temperature Short Heater (mg) |
| Test Ex. 1 | 0.4 | 70 | 8 |
| Test Ex. 2 | 0.4 | 65 | 8 |
| Test Ex. 3 | 0.4 | 90 | 16 |
| Test Ex. 4 | 0.4 | 100 | 20 |
| Test Ex. 5 | 0.4 | 180 | 22 |
| Test Ex. 6 | 0.4 | 190 | 27 |
| Comp. Ex. 1 | 0.4 | 2200 | 75 |
| Comp. Ex. 2 | 0.4 | 620 | 125 |
| Comp. Ex. 3 | 0.4 | 1100 | 65 |
| Comp. Ex. 4 | 0.4 | 540 | 130 |
| Comp. Ex. 5 | 0.4 | 570 | 180 |
| Comp. Ex. 6 | 0.4 | 580 | 210 |
| Comp. Ex. 7 | 0.4 | 370 | 105 |

TABLE 2-continued

| Lubricating agent which was used | Evaluation of Heater Deposit | | |
|---|---|---|---|
| | Adhesion Percentage (%) | Contact Heater (mg) | High Temperature Short Heater (mg) |
| Comp. Ex. 8 | 0.4 | 1950 | 70 |
| Comp. Ex. 9 | 0.4 | 2340 | 80 |
| Comp. Ex. 10 | 0.4 | 650 | 120 |
| Comp. Ex. 16 | 0.4 | 340 | 60 |
| Comp. Ex. 17 | 0.4 | * | * |

In Table 2:
Test Ex. and Comp. Ex.: Test and comparison examples as described above
Adhesion Percentage: Amount (in %) of lubricating agent which adheres to partially oriented yarns of polyester filaments
Comparison. Ex. 17: Lubricating agent containing linear polydimethylsiloxane with average molecular weight 5000, cyclic polydimethylsiloxane with 6 dimethylsiloxane units which are cyclically bonded and polyoxyethylene (8) octylether at weight ratio of 100/90/1
*: Yarn breakage occurred too frequently and continuous operation was impossible.

Part 3 (Adhesion of Lubricating Agents onto Partially Oriented Nylon Yarns and Its Evaluation)

An aqueous emulsion with 10% concentration of lubricating agent was obtained by mixing 2 parts of potassium salt of polyoxyethylene (3) oleylether phosphate and 3 parts of trioctylamine oxide as antistatic agent, and 5 parts of polyoxyethylene (8) octylether as emulsifier to 100 parts of each lubricating agent obtained in Part 1 and adding water to this mixture. After a nylon 6.6 chip with sulfuric acid relative viscosity 2.4 containing titanium oxide by 0.3 weight % was dried by a conventional method, it was spun by means of an extruder at 290° C. The aqueous emulsion was applied by a guide oiling method to the running filaments which were extruded from the spinneret and cooled for caking, and the filaments were wound up at the rate of 4100 m/minute without mechanical drawing to obtain a wound 8 kg cake of 30-denier, 10-filament partially oriented yarns, as shown in Table 3.

Each of the cakes, obtained as described above, was used to carry out false twisting by means of a false twister with a contact heater under the same conditions as in Part 2 except the following:

Speed of yarn: 950 m/minute

Draw ratio: 1.225

Twisting system: One guide disk on entrance side, one guide disk on exit side, and five ceramic disks Temperature of heater on twist side: 225° C.

Intended number of twisting: 3000 t/m.

The results evaluated as in Part 2 are also shown in Table 3.

Each of the cakes, obtained as described above, was used to carry out false twisting by means of a false twister with a high temperature short heater under the same conditions as in Part 2 except the following:

Speed of yarn: 1200 m/minute

Draw ratio: 1.220

Twisting system: One guide disk on entrance side, one guide disk on exit side, and five ceramic disks Heater on twist side: surface temperature 440° C. at the entrance section and 360° C. at the exit section Intended number of twisting: 3000 t/m. The results evaluated as in Part 2 are also shown in Table 3.

TABLE 3

| Lubricating agent which was used | Evaluation of Heater Deposit | | |
|---|---|---|---|
| | Adhesion Percentage (%) | Contact Heater (mg) | High Temperature Short Heater (mg) |
| Test Ex. 7 | 0.45 | 80 | 18 |
| Test Ex. 8 | 0.45 | 175 | 28 |
| Comp. Ex. 9 | 0.45 | 1600 | 110 |
| Comp. Ex. 10 | 0.45 | 470 | 140 |
| Comp. Ex. 11 | 0.45 | 690 | 80 |
| Comp. Ex. 12 | 0.45 | 420 | 150 |
| Comp. Ex. 13 | 0.45 | 400 | 165 |
| Comp. Ex. 14 | 0.45 | 670 | 190 |
| Comp. Ex. 15 | 0.45 | 390 | 110 |
| Comp. Ex. 16 | 0.45 | 400 | 75 |
| Comp. Ex. 17 | 0.45 | * | * |
| Comp. Ex. 8 | 0.45 | 2050 | 75 |

In Table 3:
Test Ex. and Comp. Ex.: Test and comparison examples as described above
Adhesion Percentage: As explained above
*: Same as in Table 2

Part 4 (Adhesion of Lubricating Agents onto Direct Spin-Draw Polyester Yarns and Its Evaluation)

An aqueous emulsion with 10% concentration of lubricating agent was obtained by mixing 2 parts of triethanolamine salt of isostearic acid as antistatic agent and 8 parts of polyoxyethylene (15) castor oil ether as emulsifier to 100 parts of each lubricating agent obtained in Part 1 and adding water to this mixture. The aqueous emulsion was applied by a guide oiling method to the running polyester filaments which were pulled by a first godet roller rotating at 4000 m/minute and mechanically drawn between a second godet roller and the first godet roller and wound up at the rate of 6000 m/minute to obtain a wound 5 kg cake of 50-denier, 24-filament direct spin-draw yarns.

Each of the cakes, obtained as described above, was used to carry out false twisting by means of a false twister with a contact heater and a false twister with a high temperature short heater under the same conditions as in Part 2, except the draw ratio was 1.518, the overfeed ratio was 3% and the false twisting speed of yarn was 800 m/minute. The results of evaluation, as done in Part 2, are shown in Table 4.

It should be clear from all these results that lubricating agents and methods according to this invention can prevent heat deposits sufficiently well in the heat treatment process of synthetic yarns even if it is a false twisting process including a very high temperature heat treatment.

TABLE 4

| Lubricating agent which was used | Evaluation of Heater Deposit | |
|---|---|---|
| | Contact Heater (mg) | High Temperature Short Heater (mg) |
| Test Ex. 1 | 60 | 10 |
| Test Ex. 2 | 60 | 8 |
| Comp. Ex. 1 | 1930 | 110 |
| Comp. Ex. 3 | 980 | 80 |
| Comp. Ex. 4 | 505 | 125 |
| Comp. Ex. 5 | 520 | 190 |
| Comp. Ex. 6 | 495 | 195 |
| Comp. Ex. 7 | 320 | 90 |

What is claimed is:

1. A lubricating agent for synthetic yarns which are to be subjected to a heat treatment process, said lubricating agent comprising a polyether compound and cyclic polyorganosiloxane of one or more kinds selected from Type A and Type B at a weight ratio of (polyether compound/cyclic polyorganosiloxane)=100/0.05–100/12, said Type A being cyclic polyorganosiloxane having within the molecule thereof 4–14 siloxane units shown by Formula (1) connected in a ring form, said Type B being cyclic polyorganosiloxane having within the molecule thereof a total of 4–14 siloxane units shown by Formula (1) and siloxane units shown by Formula (2) connected in a ring form such that the siloxane units shown by Formula (2) are less than 25 molar % of all siloxane units of said Type B, Formula (1) being:

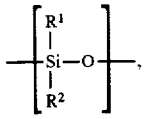

and Formula (2) being:

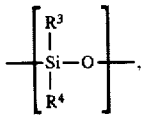

where $R^1$ and $R^2$ are same or different alkyl groups with 1–4 carbon atoms, $R^3$ is fluoroalkyl group with 1–4 carbon atoms, and $R^4$ is fluoroalkyl group with 1–4 carbon atoms or alkyl group with 1–4 carbon atoms.

2. The lubricating agent of claim 1 wherein the siloxane units shown by Formula (1) of said cyclic polyorganosiloxane are dimethylsiloxane units.

3. The lubricating agent of claim 2 wherein said polyether compound has average molecular weight of 700–20000.

4. The lubricating agent of claim 2 wherein said polyether compound is a mixture of polyether compound of first kind with average molecular weight of 1000–3000 and polyether compound of second kind with average molecular weight of 5000–15000.

5. The lubricating agent of claim 1 wherein said polyether compound has average molecular weight of 700–20000.

6. The lubricating agent of claim 1 wherein said polyether compound is a mixture of polyether compound of first kind with average molecular weight of 1000–3000 and polyether compound of second kind with average molecular weight of 5000–15000.

7. A method of providing lubricity to synthetic yarns which are to be subjected to a heat treatment process, said method comprising the step of applying a lubricating agent to the synthetic yarns at a rate of 0.1–3 weight % of said synthetic yarns, said lubricating agent comprising a polyether compound and cyclic polyorganosiloxane of one or more kinds selected from Type A and Type B at a weight ratio of (polyether compound/cyclic polyorganosiloxane)=100/0.05–100/12, said Type A being cyclic polyorganosiloxane having within the molecule thereof 4–14 siloxane units shown by Formula (1) connected in a ring form, said Type B being cyclic polyorganosiloxane having within the molecule thereof a total of 4–14 siloxane units shown by Formula (1) and siloxane units shown by Formula (2) connected in a ring form such that the siloxane units shown by Formula (2) are less than 25 molar % of all siloxane units of said Type B, Formula (1) being:

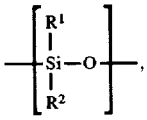

and Formula (2) being:

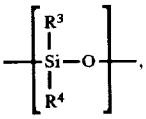

where $R^1$ and $R^2$ are same or different alkyl groups with 1–4 carbon atoms, $R^3$ is fluoroalkyl group with 1–4 carbon atoms, and $R^4$ is fluoroalkyl group with 1–4 carbon atoms or alkyl group with 1–4 carbon atoms.

8. The method of claim 7 wherein the siloxane units shown by Formula (1) of said cyclic polyorganosiloxane are dimethylsiloxane units.

9. The method of claim 7 wherein said polyether compound has average molecular weight of 700–20000.

10. The method of claim 7 wherein said polyether compound is a mixture of polyether compound of first kind with average molecular weight of 1000–3000 and polyether compound of second kind with average molecular weight of 5000–15000.

* * * * *